US005933978A

United States Patent [19]

Lehtinen et al.

[11] Patent Number: 5,933,978

[45] Date of Patent: Aug. 10, 1999

[54] METHOD OF AND APPARATUS FOR DRYING A FIBER WEB

[75] Inventors: Jukka Lehtinen, Tampere; Elias Retulainen, Kulju, both of Finland

[73] Assignee: Valmet Corporation, Helsinki, Finland

[21] Appl. No.: 08/982,143

[22] Filed: Dec. 1, 1997

[30] Foreign Application Priority Data

Dec. 10, 1996 [FI] Finland ..... 964939

[51] Int. Cl.[6] ..... D21F 5/00; F26B 7/00

[52] U.S. Cl. ..... 34/419; 34/454; 34/71; 34/95

[58] Field of Search ..... 34/417, 419, 449, 34/454, 71, 95, 117; 162/206, 207, 359.1, 360.3

[56] References Cited

U.S. PATENT DOCUMENTS 4,461,095 7/1984 Lehtinen ..... 34/41
4,506,457 3/1985 Lehtinen ..... 34/73 X
4,622,758 11/1986 Lehtinen et al. ..... 34/392
4,958,444 9/1990 Rautakorpi et al. ..... 34/71
5,799,409 9/1998 Chau-Huu et al. ..... 34/117

FOREIGN PATENT DOCUMENTS 0013400 7/1980 European Pat. Off. .
96113004 4/1996 WIPO .

*Primary Examiner*—Henry Bennett
*Assistant Examiner*—Steve Gravini
*Attorney, Agent, or Firm*—Ladas & Parry

[57] ABSTRACT

The invention relates to a method of and an apparatus for drying a fiber web, whereby the fiber web is dried in a cylinder drying unit (12) and in a band drier unit (11). The fiber web (5) is led from the cylinder drying unit (12) to the band drier unit (11) in such a way that it is easy to determine a desired dry content for the fiber web (5) in the cylinder drying unit (12) when the fiber web (5) is transferred to the band drier unit (11).

12 Claims, 2 Drawing Sheets

METHOD OF AND APPARATUS FOR DRYING A FIBER WEB

Figure 1:
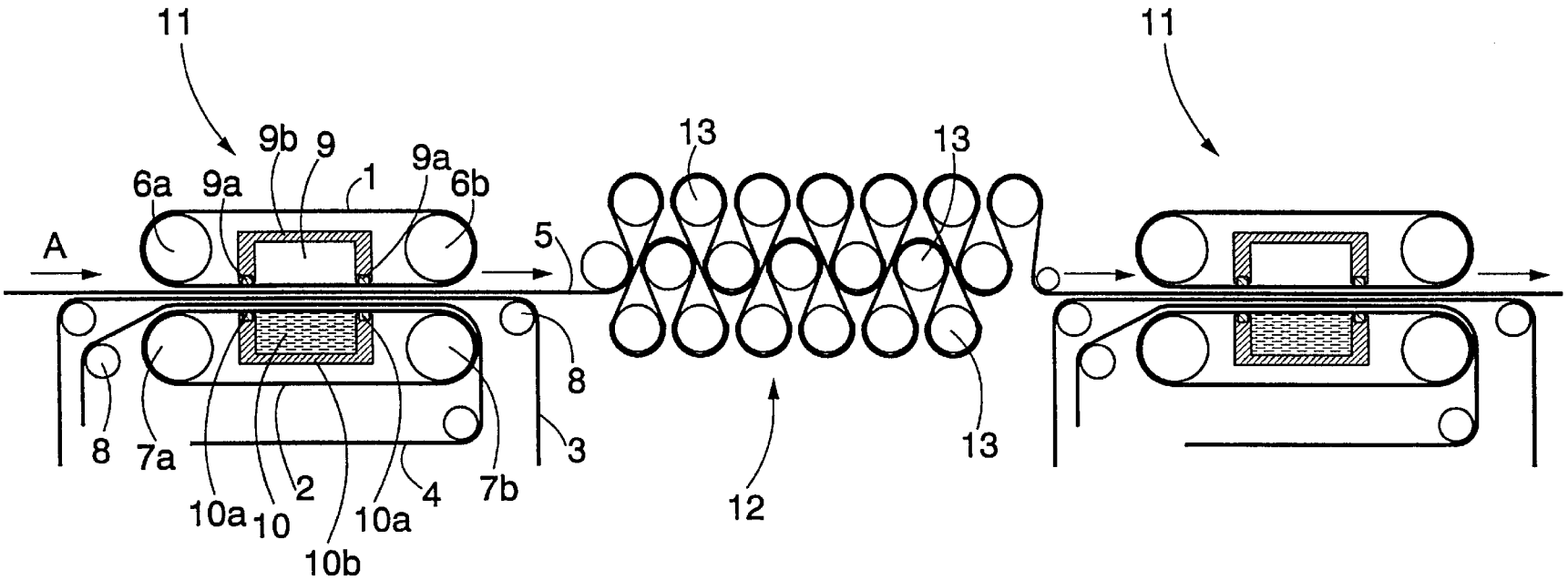

The invention relates to a method of drying a fiber web, in which method the fiber web is dried by means of drying cylinders in a cylinder drying equipment or unit, by pressing the fiber web against the surface of a drying cylinder with a felt or a drying wire, and in a band drier unit, comprising two endless air impermeable bands, first turning rolls, the first band being arranged to turn around the first turning rolls, and second turning rolls, the second band being arranged to turn around the second turning rolls, whereby the first band and the second band are arranged to run part of the way parallel with each other in such a way that they form a drying zone between them, the first band being heated and the second band being cooled, and whereby the fiber web and at least one felt or wire are led between the bands in such a way that the fiber web is in contact with the heated first band, and the felt or the wire is located between the fiber web and the cooled second band, respectively.

The invention relates further to an apparatus for drying a fiber web, the apparatus comprising a cylinder drying unit, which comprises several drying cylinders, the fiber web being pressed against the surface of the heated drying cylinders with a felt or a wire, and a band drier unit, which comprises two endless air impermeable bands, first turning rolls, the first band being arranged to turn around the first turning rolls, and second turning rolls, the second band being arranged to turn around the second turning rolls, whereby the first band and the second band are arranged to run part of the way parallel with each other so that they form a drying zone between them, the first band being arranged to be heated by heating means and the second band being arranged to be cooled by cooling means, and whereby the fiber web and at least one felt or wire are led between the bands in such a way that the fiber web is in contact with the heated first band, and the felt or the wire is located between the fiber web and the cooled second band, respectively.

Drying a fiber web between two parallel metal bands moving in the same direction in such a way that the fiber web is in contact with the heated metal band and a wire is located between the fiber web and the second cooled metal band so that the steam separated from the fiber web caused by the heating condenses to the wire by the effect of the cold metal band, is known from several patent publications, from which can be mentioned International Patent Application WO 96/11300, which is and U.S. Pat. No. 4.461.095, for instance. The operation is based on that two endless metal bands are arranged to run around turning rolls and pressure chambers containing hot steam and water, respectively, are provided against the inner surface defined by the loops formed by the bands so that the pressure produced presses the hot and the cold band, and respectively, the fiber web and the wire between them towards each other. The bands located between the pressure chambers form by means of seals one side for the pressure chambers so that the steam and water can directly affect the bands. The operation of the apparatus is fully known per se and has been disclosed for instance in the above patent publications, which are incorporated herein by reference.

In a cylinder drying unit, a fiber web is dried by means of several drying cylinders. The drying cylinders are heated and the fiber web is pressed against the surface of a drying cylinder with a felt or a drying wire. However, a drawback of using only a cylinder drying unit arises from the big size, high purchase price and high operating costs of the drying unit, for instance. Another drying arrangement is presented in which the fiber web is initially led to be dried between two moving, heated and cooled metal bands, and subsequently, to the cylinder drying unit in order to prevent the fiber web from curling, for instance. In such an arrangement, however, it is rather difficult to control the properties of the fiber web, and for instance the dry content of the fiber web cannot be controlled in any way before the fiber web is fed between the metal bands.

The object of the present invention is to provide a method and an apparatus, by means of which a fiber web can be dried quickly, advantageously and effectively.

The method according to the invention is characterised in that the fiber web is led from the cylinder drying unit to the band drier unit.

Further, the apparatus according to the invention is characterised in that the fiber web is arranged to be led from the cylinder drying unit to the band drier unit.

The essential idea of the invention is that a fiber web is dried by means of an apparatus comprising a band drier unit, which comprises two parallel bands moving in the same direction in such a way that the fiber web is in contact with the heated band and a wire is located between the fiber web and the second cooled band so that the steam separated from the fiber web caused by the heating condenses to the wire by the effect of the cooled band, and in addition to that, a cylinder drying unit, and that the fiber web is led from the cylinder drying unit to the band drier unit. Moreover, the idea of a preferred embodiment is that the band drier unit or the band drier units are placed above and/or below the cylinder drying unit.

An advantage of the invention is that, by leading the fiber web from the cylinder drying unit to the band drier unit, it is possible to determine the dry content of the fiber web in the cylinder drying unit as desired at the moment when the fiber web arrives at the band drier unit. Desired strength and thickness properties can thus easily be adjusted for the fiber web. Further, impurities from the fiber web adhere during initial drying to the cylinders, from which the impurities can easily be scraped off. By arranging the band drier units above and/or below the cylinder drying unit, a considerable space saving is achieved and conveying the fiber web to the cylinder drying unit can be arranged in an easy and simple manner.

The invention is described in greater detail in the attached drawings, in which

Figure 2:
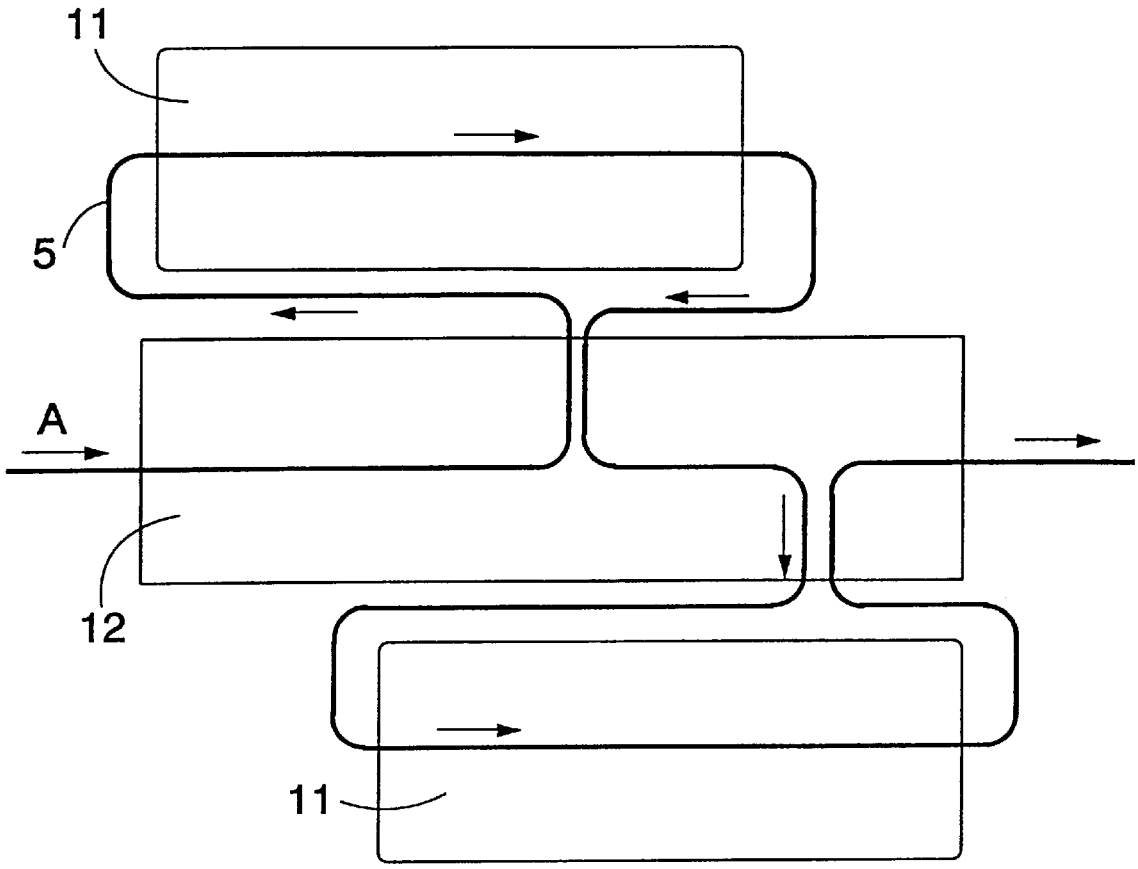

FIG. 1 shows a schematic sectional side view taken in the travel direction of the web and illustrating an apparatus for drying a fiber web according to the invention, and FIG. 2 shows a schematic sectional side view taken in the travel direction of the web and illustrating another apparatus for drying a fiber web according to the invention.

FIG. 1 is a schematic sectional side view taken in the travel direction of a web and illustrating an apparatus according to the invention. The arrangement comprises a drier unit formed by endless bands that are impermeable to air, conduct heat well and are preferably made of metal: viz. a first band 1, i.e. an upper band, and a second band 2, i.e. a lower band, a fine wire or felt 3, a coarse wire 4 and the fiber web 5 running between those surfaces of the bands that face each other. The fiber web 5 moves in the direction indicated by arrow A. The movement of the fiber web 5 is illustrated also by means of other arrows. The first band 1 is arranged to turn around first turning rolls 6*a* and 6*b* located at the ends of the drier unit. Correspondingy, the second band 2 is arranged to turn around second turning rolls 7*a* and 7*b* also located at the ends of the drier unit, below the first turning rolls 6*a* and 6*b*. The wires 3 and 4 are supported and guided by guide rolls 8. Since the pressure prevailing in the drying zone in the area between the bands 1 and 2 is usually different from the pressure prevailing outside or on the sides of the bands 1 and 2, seals are arranged on both sides of the unit between or at the edges of the bands 1 and 2, the seals preventing liquid or gas from moving out of the area between the bands 1 and 2 sidewards, or vice versa. To effect vapor heating required for the drying, the drier unit comprises a pressure chamber 9, which is located above the first band 1. The first band 1 is sealed with seals 9*a* to the body 9*b* of the pressure chamber 9 so that the steam in the pressure chamber 9 remains at a suitable pressure. Below the second band 2 there is a water chamber 10 containing water that cools the second band 2. At the edges of the water chamber 10 there are seals 10*a,* with which the second band 2 is sealed to the body 10*b* of the water chamber 10. In this application, this drier unit is called a band drier unit 11.

The operation of the band drier unit 11 is based on heating the first band 1, which is in contact with the web 5, by hot steam contained in the pressure chamber 9. Then the temperature of the first band 1 causes that the water in the web 5 is vaporized and transferred through the wires 3 and 4 toward the second band 2. The second band 2, in turn, is continuously cooled with water located below it, whereby the steam produced on its surface condenses into water and is removed with the band 2 and the wire 4.

The apparatus further comprises a cylinder drying unit 12, which comprises drying cylinders 13, against the surface of which the fiber web 5 is pressed with a felt or a drying wire for drying the fiber web 5 in a manner known per se. For the sake of clarity, FIG. 1 does not show the wires by which the fiber web 5 is pressed against the drying cylinders 13 of the cylinder drying unit 12 and by which the fiber web 5 is guided in the drying unit.

The cylinder drying unit 12 is positioned after a band drier unit 11 and another band drier unit 11 is positioned after the cylinder drying unit 12. Accordingly, the band drier units 11 are then used for initial and final drying of the fiber web and, in the cylinder drying unit 12, additional processing of the fiber web can be carried out, such as coating and calendering. Curling of the fiber web 5 can also be corrected by means of the cylinder drying unit 12. By means of the cylinder drying unit 12, it is easy to provide the fiber web 5 with a desired dry content, in which the fiber web 5 is led to the latter band drier unit 11. The strength, thickness and elastic properties of the fiber web 5 can then easily be adjusted as desired.

FIG. 2 is a schematic sectional side view taken in the travel direction of the web and illustrating another apparatus according to the invention. For the sake of clarity, FIG. 2 does not show detailed structures of the band drier unit 11 and the cylinder drying unit 12, and also for the sake of clarity, the route of the fiber web 5 is shown only approximately. The movement of the fiber web 5 is illustrated by arrows. The drying units are positioned in such a way that a band drier unit 11 is located above the cylinder drying unit 12 and another band drier unit 11 below it. The building costs of such an arrangement are low and the arrangement can be utilized in connection with an existing cylinder drying unit 12, for instance. There is often room above or below the cylinder drying unit 12, or it is relatively easy to arrange room for the band drier unit 12. Placing the drying units one above the other also makes it possible to lead the fiber web 5 easily up or down to the band drier units 11 at separate places of the cylinder drying unit 12 and further from the band drier units 11 back to the cylinder drying unit. Naturally, both band drier units 11 could be either above or below the cylinder drying unit 12.

In FIG. 2, the fiber web 5 is led initially to the cylinder drying unit 12, where it can be dried to a suitable dry content to be led to the band drier unit 11. From the cylinder drying unit 12, the fiber web 5 is led to the upper band drier unit 11 and from there, if desired, through the cylinder drying unit 12 to the lower band drier unit 11 and, if desired, from the lower band drier unit 11 back to the cylinder drying unit 12, where possible curling finally can be removed from the fiber web 5 The separate band drier units 11 can be arranged to dry the fiber web 5 for instance in such a way that one of them is drying the fiber web 5 on the surface side and the other one on the opposite side with respect to that, which gives the fiber web 5 a uniform quality. The band drier units 11 can also be arranged one after the other to dry the fiber web 5, in which case the fiber web 5 between them cannot shrink substantially in the transverse direction, as is often the case, if the fiber web 5 is dried between the band drier units 11 in the cylinder drying unit 12.

The drawings and the description relating to them are only intended to illustrate the idea of the invention. As far as the details are concerned, the invention may vary within the scope of the claims. Accordingly, in the simplest case, the apparatus comprises a cylinder drying unit 12 and one band drier unit 11, the fiber web being led from the cylinder drying unit 12 to the band drier unit 11. Further, it is not essential which pressure medium is used in the pressure chamber 9 and the water chamber 10. The medium of the pressure chamber 9 can thus be steam, air, or hot combustion products of fuel, or water, for instance. In addition to water, also for instance air can be used as medium in the water chamber 10.

In addition to the heating caused by the pressure chamber 9, the first band 1 can also be heated at other places in manners fully known per se. Further, the heating of the first band 1 can take place entirely outside the pressure chamber 9 or the drying of the fiber web 5 can even take place without a pressure chamber 9.

Moreover, the second band 2 can also be cooled outside the water chamber 10 or the cooling can be implemented without a water chamber 10 in manners fully known per se.

Further, one band drier unit 11 can also be arranged such that it is heated by means of the pressure chamber 9 and cooled by means of the water chamber 10, and the other band drier unit 11 can be arranged to be heated and cooled without these chambers. Likewise, the arrangement may comprise more than two band drier units 11 and more than one cylinder drying unit 12.

We claim:

1. Method of drying a fiber web, in which method the fiber web is dried by means of drying cylinders in a cylinder drying unit, by pressing the fiber web against the surface of a drying cylinder with a felt or a drying wire, and in a band drier unit, comprising two endless air impermeable bands, first turning rolls, the first band being arranged to turn around the first turning rolls, and second turning rolls, the second band being arranged to turn around the second turning rolls, whereby the first band and the second band are arranged to run part of the way parallel with each other so that they form a drying zone between them, the first band being heated and the second band being cooled, and whereby the fiber web and at least one felt or wire are led between the bands in such a way that the fiber web is in contact with the heated first band, and the felt or the wire is located between the fiber web and the cooled second band, respectively, wherein the fiber web is led from the cylinder drying unit to the band drier unit.

2. Method according to claim 1, wherein at least two band drier units are used for drying the fiber web.

3. Method according to claim 2, wherein the fiber web is initially led to a band drier unit and from there to a cylinder drying unit and after that to another band drier unit.

4. Method according to claim 2, wherein the opposite sides of the fiber web are dried by means of the separate band drier units.

5. Method according to claim 1, wherein the band drier unit or the band drier units are located above and/or below the cylinder drying unit.

6. Method according to claim 1, wherein the fiber web is led from the band drier unit back to the cylinder drying unit.

7. Apparatus for drying a fiber web, the apparatus comprising a cylinder drying unit, which comprises several drying cylinders, the fiber web being pressed against the surface of the heated drying cylinders with a felt or a wire, and a band drier unit, which comprises two endless air impermeable bands, first turning rolls, the first band being arranged to turn around the first turning rolls, and second turning rolls, the second band being arranged to turn around the second turning rolls, whereby the first band and the second band are arranged to run part of the way parallel with each other so that they form a drying zone between them, the first band being arranged to be heated by heating means and the second band being arranged to be cooled by cooling means, and whereby the fiber web and at least one felt or wire are led between the bands in such a way that the fiber web is in contact with the heated first band, and the felt or the wire is located between the fiber web and the cooled second band, respectively, wherein the fiber web is arranged to be led from the cylinder drying unit to the band drier unit.

8. Apparatus according to claim 7, wherein the apparatus comprises at least two band drier units.

9. Apparatus according to claim 8, wherein the fiber web is arranged to be led initially to one band drier unit, then to the cylinder drying unit and from there further to the other band drier unit.

10. Apparatus according to claim 8, wherein the separate band drier units are arranged to dry the fiber web on opposite sides.

11. Apparatus according to claim 7, wherein the band drier unit or the band drier units are located above and/or below the cylinder drying unit.

12. Apparatus according to claim 7, wherein the fiber web is arranged to be led from the band drier unit back to the cylinder drying unit.

* * * * *